US006114935A

United States Patent [19]

Oosuka et al.

[11] Patent Number: 6,114,935

[45] Date of Patent: Sep. 5, 2000

[54] IGNITION COIL HAVING COIL CASE

[75] Inventors: Kazutoyo Oosuka, Gamagori; Yoshihiro Shimoide, Tokai; Kazuhide Kawai, Kariya; Jyunichi Wada, Chita-gun, all of Japan

[73] Assignee: Denso Corporation, Japan

[21] Appl. No.: 09/082,528

[22] Filed: May 21, 1998

[30] Foreign Application Priority Data

May 22, 1997 [JP] Japan ..... 9-131540
Aug. 7, 1997 [JP] Japan ..... 9-212798

[51] Int. Cl.[7] ..... H01F 27/04

[52] U.S. Cl. ..... 336/107; 336/90; 336/96

[58] Field of Search ..... 336/105, 107, 336/90, 92, 110, 96, 100, 198; 123/634, 647

[56] References Cited

U.S. PATENT DOCUMENTS 964,007 7/1910 England ..... 336/107
5,870,012 2/1999 Sakamaki et al. ..... 336/107

FOREIGN PATENT DOCUMENTS 9-275026 10/1997 Japan .

*Primary Examiner*—Michael L. Gellner
*Assistant Examiner*—Tuyen T. Nguyen
*Attorney, Agent, or Firm*—Nixon & Vanderhye PC

[57] ABSTRACT

An ignition coil has a coil case made of an insulating resin, including a head portion, a cylinder portion accommodating a primary coil, and a secondary coil and a high-voltage tower portion for fitting with a spark plug. At least one of those three portions is separately molded and then the portions are assembled to form the coil case. The longitudinal length of each of the three portions is less than a forming flow length of the insulating resin, thereby preventing inferior molding. Further, the structure of each molding die is simpler than that of the coil case for an integral molding. Therefore, the coil case of the ignition coil can be molded readily without molding defects, even when the coil case is elongated, formed thinner, and/or formed with an undercut portion.

13 Claims, 6 Drawing Sheets

IGNITION COIL HAVING COIL CASE

CROSS-REFERENCE TO RELATED APPLICATION

This application relates to and claims priority from Japanese Patent Application Nos. Hei 9-131540 filed May 22, 1997 and Hei 9-212798 filed Aug. 7, 1997, the entire contents of which are incorporated herein by reference.

BACKGROUND OF THE INVENTION

1. Field of the Invention

The present invention relates to a stick type ignition coil attached inside a plug hole provided on each of the engine cylinders of an internal combustion engine.

2. Related Art

One type of known stick type ignition coil has a coil case, primary and secondary coils and magnetic cores. The coil case is made of resin and has a cylindrical shape. The primary and secondary coils and the cores are accommodated in the coil case. The coil case has a connector housing at the upper part of the coil case to connect the primary coil to a battery. The coil case also has a high-voltage tower portion at the lower part of the coil case. The high-voltage tower portion is to be inserted into a plug hole provided on a cylinder head of an engine cylinder, and is attached to a spark plug so that a high-voltage terminal (a secondary terminal) of the secondary coil is electrically connected to the spark plug.

In the above-described stick type ignition coil, an outer diameter of the ignition coil is limited by an inner diameter of the plug hole; that is, the outer diameter of the ignition coil must be smaller than the inner diameter of the plug hole. Therefore, to improve boosting (voltage amplification) performance of the ignition coil, a longitudinal length of the coil case is increased so that a number of windings of the primary and secondary coils can be increased. Further, to improve voltage proof performance inside the coil case, the coil case is formed thinner to increase insulating space.

According to such ignition coil, insulating resin such as polybutylene terephthalate (PBT), polyethylene terephthalate (PET) or polyphenylene sulfide (PPS) are used for forming the coil case. JP-A-8-339928 discloses that PPS is suitable for forming the coil case due to its excellent flowability.

However, when the coil case is formed thinner or elongated further to improve performance of the ignition coil, an integral molding to form the coil case becomes difficult even when the coil case is made of PPS which is preferable to mold. Further, if the coil case has an undercut portion, the structure of a molding die for the integral molding becomes extremely complicated, resulting in a high molding cost.

SUMMARY OF THE INVENTION

The present invention was made in light of the foregoing problem, and it is an object of the present invention to provide an ignition coil having a coil case which can achieve an easy integral molding without molding defects even when the coil case is formed thinner, elongated or formed with an undercut portion.

According to the present invention, an ignition coil has a coil case made of resin including a head portion, a cylinder portion and a high-voltage tower portion. At least one of those three portions is separately molded and then connected with each other to form the coil case. Therefore, because each of the three portions from which the coil case is made has a length less than a forming flow length of the resin, even when the coil case is elongated or formed thinner, the coil case can be molded properly without causing molding defects. Further, when the coil case has an undercut portion, the portion including the undercut portion is formed separately. Therefore, the other portions without an undercut portion can be formed using a comparatively simply structured molding die, thereby improving molding efficiency.

Preferably, an elastomer is attached to a peripheral core disposed inside the cylinder portion, and is interposed between the peripheral core and the coil case for preventing the coil case from cracking. Therefore, joint portions of the coil case are sealed by the elastomer and do not require another seal. This results in a reduction in production cost of the ignition coil.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Embodiments of the present invention will be described hereinafter with reference to the accompanying drawings.

(First Embodiment)

Figure 1:
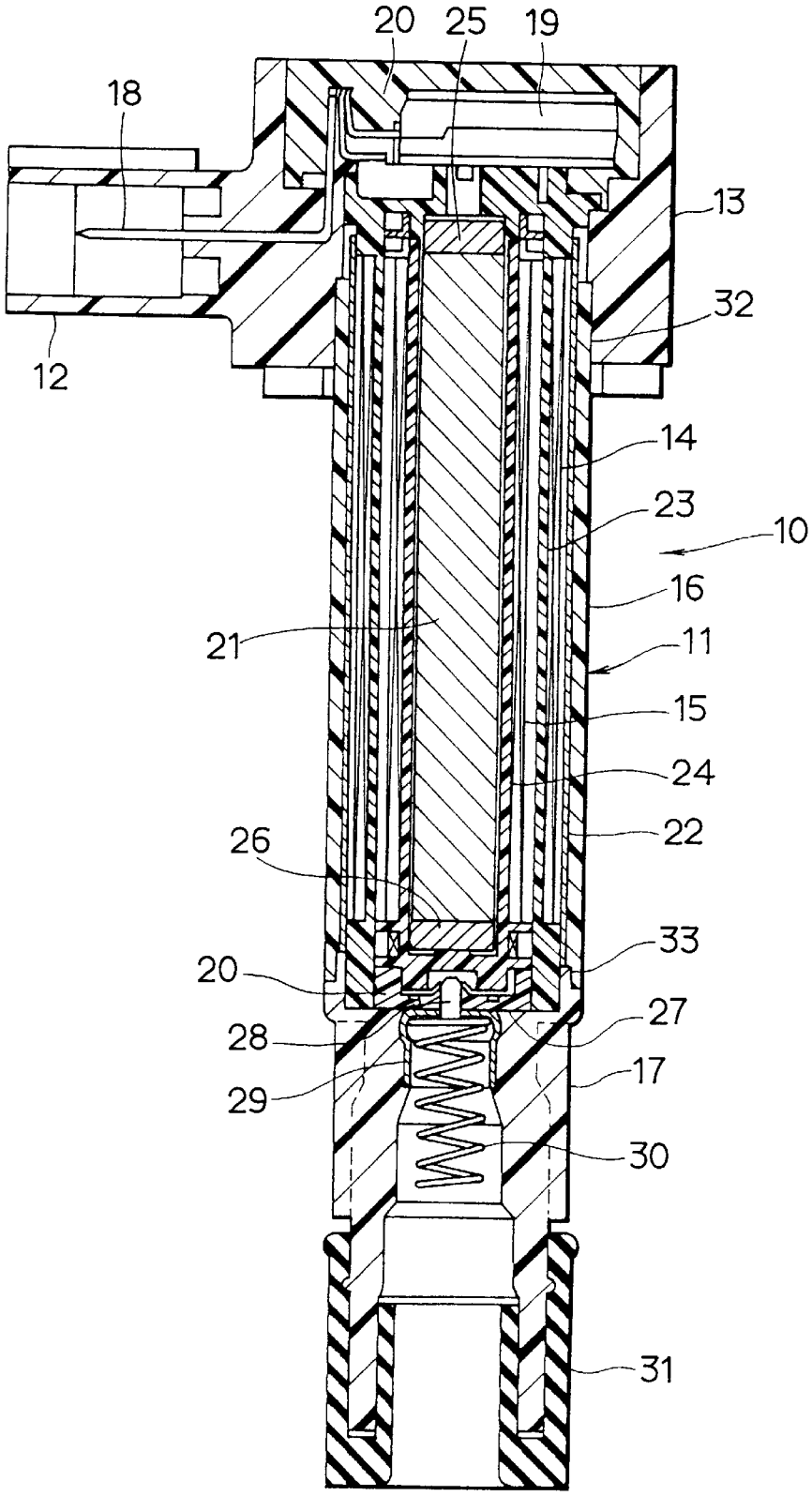
FIG. 1 is a cross-sectional view showing an ignition coil according to a first embodiment of the present invention.

As shown in FIG. 1, an ignition coil 10 includes a coil case 11 having a head portion 13, a cylinder portion 16 and a high-voltage tower portion 17. The head portion 13 has a connector housing 12. The cylinder portion 16 is formed into a cylindrical shape and accommodates a primary coil 14 and a secondary coil 15. The high-voltage tower portion 17 is to be attached to a spark plug (not shown). The head portion 13, the cylinder portion 16 and the high-voltage tower portion 17 are separately molded out of insulating resin such as polybutylene terephthalate (PBT), polyethylene terephthalate (PET) or polyphenylene sulfide (PPS), and then assembled to form the coil case 11. The whole length of the coil case 11 in a longitudinal direction is 130 mm or more.

The connector housing 12, which is formed with a connector pin 18 by insert-molding, is integrally molded with the head portion 13. An igniter 19 is installed in the head portion 13. Ignition signals outputted from an engine controlling computer (not shown) are inputted to the igniter 19 via the connector pin 18. The inside of the head portion 13 is vacuum-filled with a thermosetting resin 20 such as epoxy thermosetting resin for insulation sealing.

The cylinder portion 16 has a thickness of 1.0 mm or less and accommodates a center core 21 having a stick shape at a center part of the cylinder portion 16 and a peripheral core 22 having a cylindrical shape at a peripheral side so that the center core 21 and the peripheral core 22 are disposed in a concentric way. The primary coil 14 is wound around a bobbin 23 made of insulating resin and is attached to inside of the peripheral core 22. Further, the secondary coil 15 is wound around a bobbin 24 made of insulating resin and is attached to inside of the primary coil 14. At top and bottom ends of the center core 21, magnets 25, 26 are disposed respectively. The magnets 25, 26 have a polarity opposite to a magnetic flux, which is excited and generated by the primary and secondary coils 14, 15. A terminal plate 27 connected to one end of the secondary coil 15 is attached to the bottom surface of the cylinder portion 16. A gap in the cylinder portion 16 is also vacuum-filled with the thermosetting resin 20 such as epoxy thermosetting resin for insulation sealing.

A terminal cup 29 is formed in an upper center part of the high-voltage tower portion 17 by the insert-molding. A high-voltage terminal (a secondary terminal) 28 is connected to the terminal cup 29, facing upward. A conductive spring 30 is disposed inside a cup portion of the terminal cup 29, which is opened downward, and is engaged with the terminal cup 29. The high-voltage terminal 28 is pressed and held against the terminal plate 27 to be conductive with each other. The lower part of the high-voltage tower portion 17 is formed into a cylindrical shape, and a plug cap 31 made of rubber is attached to a bottom end of the high-voltage tower portion 17. By press-fitting the plug cap 31 into an upper part of the spark plug (not shown), the high-voltage tower portion 17 and the spark plug are kept being connected due to elastic force of the plug cap 31, and the spring 30 is pressed against a terminal of the spark plug. Therefore, one end of the secondary coil 15 is electrically connected to the terminal of the spark plug via the terminal plate 27, the high-voltage terminal 28, the terminal cup 29 and the spring 30. The high-voltage tower portion 17 is also vacuum-filled with the thermosetting resin 20 such as epoxy thermosetting resin for insulation sealing.

Each of a joint portion 32 between the head portion 15 and the cylinder portion 16 and a joint portion 33 between the cylinder portion 16 and the high-voltage tower portion 17 is press-fitted and bonded using adhesives for sealing.

The coil case 11 is often made of PBT having an excellent adhesiveness against the epoxy thermosetting resin 20 which fills the inside of the coil case 11. The forming flow length of PBT is approximately 105 mm when it has a thickness of 1 mm, and 37 mm when it has a thickness of 0.5 mm. However, the coil case 11 has a length of 130 mm or more in a longitudinal direction, and the cylinder portion 16 of the coil case 11 has a thickness of 1.0 mm or less. Therefore, if the coil case 11 is integrally molded out of PBT, PBT does not reach all cavities of the mold because a longitudinal length of the coil case 11 is longer than the forming flow length of PBT. This may cause a defective molding of the coil case 11.

According to the first embodiment, the head portion 15, the cylinder portion 16 and the high-voltage tower portion 17 are molded separately out of PBT so that each longitudinal length of the portions is smaller than the forming flow length of PBT. Therefore, the coil case 11 can be molded without defects even when the coil case 11 is formed thinner or elongated. When the coil case 11 has an undercut portion, because a portion of the coil case 11 including the undercut portion is formed separately, other portions of the coil case 11 can be molded using a molding die of comparatively simple structure without an undercut portion. This improves molding efficiency of the coil case 11.

(Second Embodiment)

Figure 2:
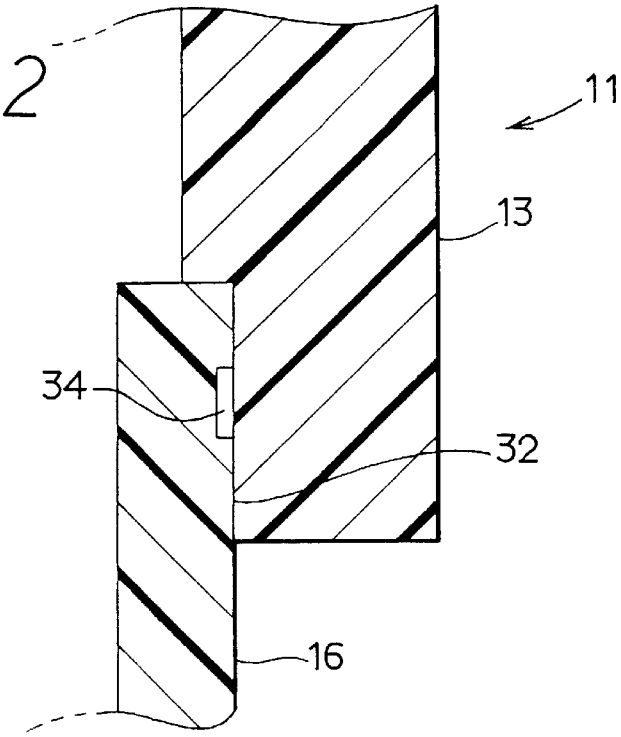
FIG. 2 is an enlarged partial cross-sectional view showing a connection structure between a head portion and a cylinder portion according to a second embodiment of the present invention.
Figure 3:
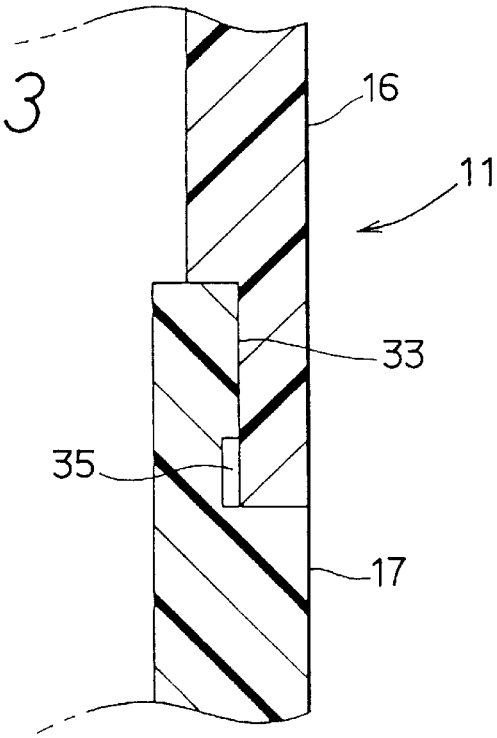
FIG. 3 is an enlarged partial cross-sectional view showing a connection structure between the cylinder portion and a high-voltage tower portion according to the second embodiment of the present invention.
Figure 4:
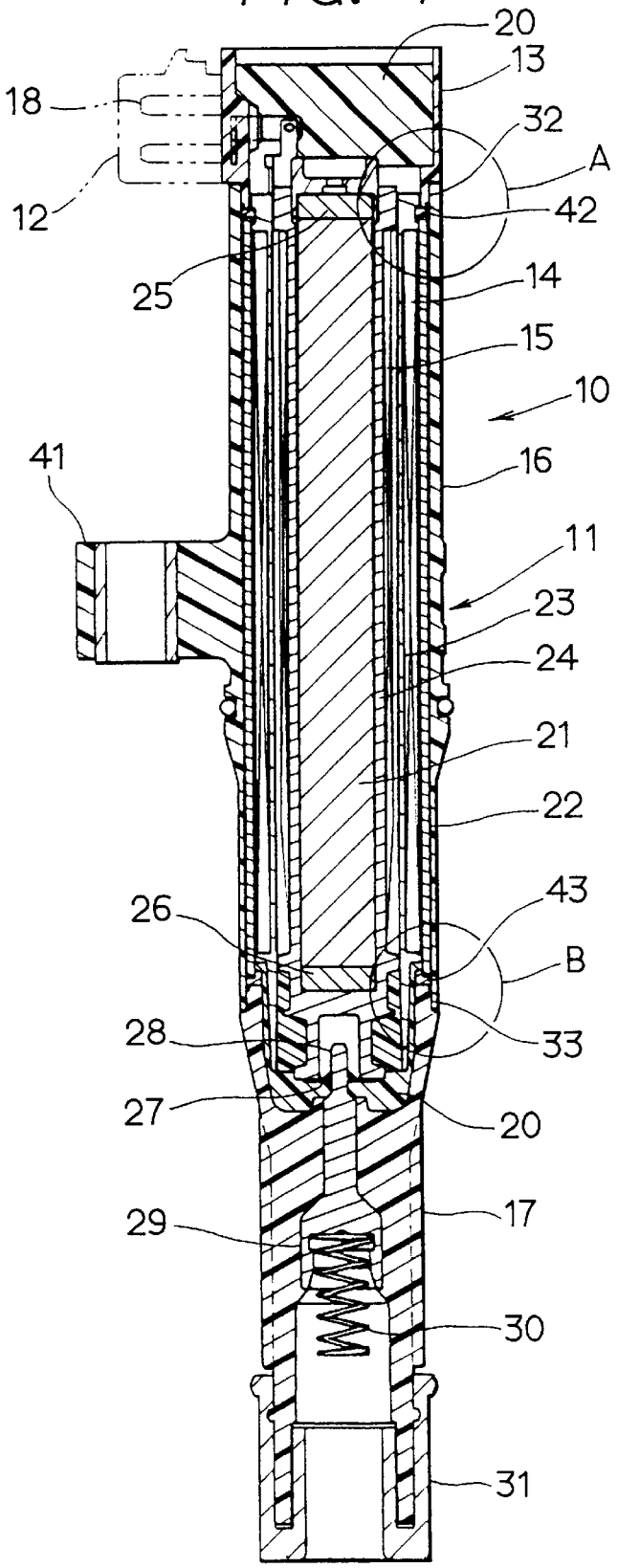
FIG. 4 is a cross-sectional view showing an ignition coil according to a third embodiment of the present invention.

A second embodiment of the present invention will be described with reference to FIGS. 2 and 3. In this and the following embodiments, components which are substantially the same to those in previous embodiments are assigned the same reference numerals. In the second embodiment, adhesive collecting recesses 34 and 35 are formed on bonding surfaces of a joint portion 32 between the upper end part of the cylinder portion 16 and the head portion 15, and a joint portion 33 between the lower end part of the cylinder portion 16 and the high-voltage tower portion 17. The adhesive collecting recesses 34 and 35 may be formed at the middle part of the bonding surface, as shown in FIG. 2, or at the end part of the bonding surface, as shown in FIG. 3. The adhesive collecting recesses 34 and 35 may be formed at the head portion 13, the cylinder portion 16 or the high-voltage tower portion 17. Except having the adhesive collecting recesses 34 and 35, the ignition coil 10 in the second embodiment has the same structure as the ignition coil 10 in the first embodiment.

According to the second embodiment, adhesives excessively applied to the bonding surfaces of the bonding portions 32 and 33 are collected in the adhesive collecting recesses 34 and 35 to prevent the excessive adhesives from flowing out of the bonding surfaces. Therefore, the process for wiping off the adhesives flown out of the bonding surfaces can be omitted, improving assembly efficiency of the ignition coil 10.

(Third Embodiment)

A third embodiment of the present invention will be described with reference to FIGS. 4–7. Similar to the first embodiment, in the third embodiment, the head portion 15, the cylinder portion 16 and the high-voltage tower portion 17 are separately molded and bonded each other using adhesives to form the coil case 11. In the first embodiment, the igniter 19 is installed in the head portion 13 of the coil case 11. However, in the third embodiment, an igniter (not shown) is provided outside of the coil case 11, and the connector pins 18 are connected to an output terminal of the igniter.

Figure 5:
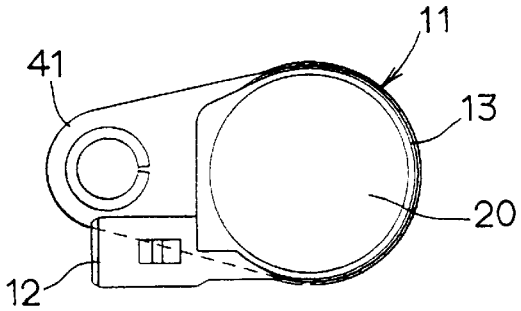
FIG. 5 is a schematic top view showing the ignition coil according to the third embodiment of the present invention.

On the outer peripheral surface of the cylinder portion 16, a bolt receiver 41 is integrally formed with the cylinder portion 16. The ignition coil 10 is connected to an engine cylinder head (not shown) with a bolt inserted through the bolt receiver 41. As shown in FIG. 5, the bolt receiver 41 is formed to be partially overlapped with the connector housing 12 when viewed from the top side of the coil case 11; that is, the bolt receiver 41 is an undercut portion.

Figure 6:
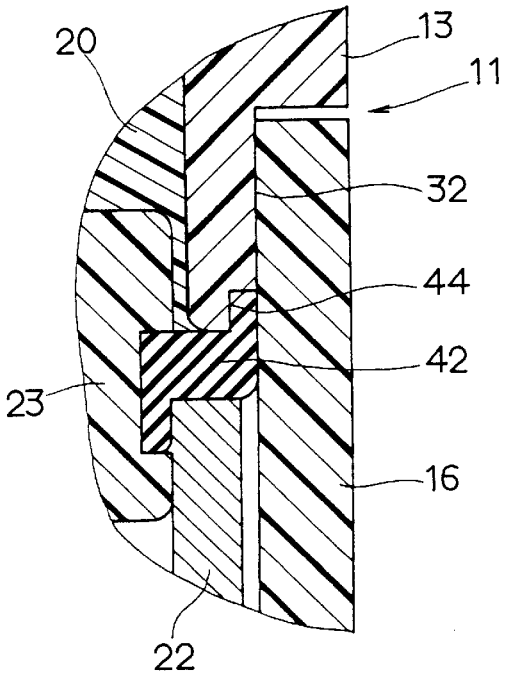
FIG. 6 is an enlarged partial cross-sectional view showing a connection structure between the head portion and the cylinder portion (portion A in FIG. 4) according to the third embodiment of the present invention.
Figure 7:
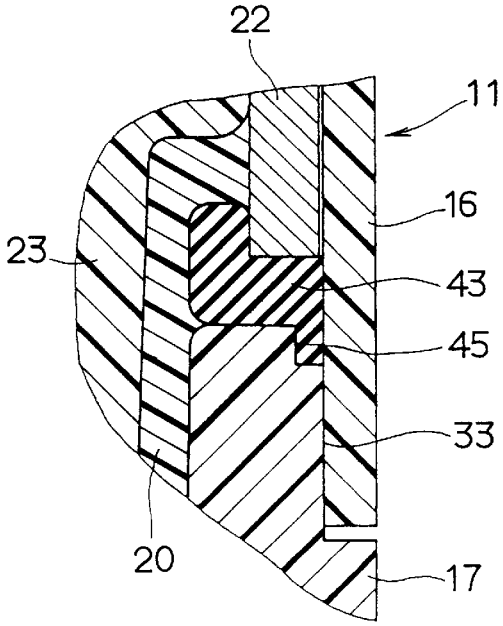
FIG. 7 is an enlarged partial cross-sectional view showing a connection structure between the cylinder portion and a high-voltage tower portion (portion B in FIG. 4) according to the third embodiment of the present invention.

Further, as shown in FIGS. 6 and 7, elastomers 42 and 43 are attached to both top and bottom ends of the peripheral core 22 for functioning as elastic cushioning material to prevent the coil case 11 from cracking due to difference in thermal expansion between the coil case 11 and the peripheral core 22. The elastomers 42 and 43 are made of an elastic material having both rubber elasticity and thermal plasticity. The elastomer 42 is interposed between the end of the peripheral core 22 and the head portion 13, and the elastomer 43 is interposed between the end of the peripheral core 22 and the high-voltage tower portion 17. The head portion 13 and the high-voltage tower portion 17 have recess portions 44 and 45 for fitting with the elastomer 42 and 43, respectively. An upper end of the elastomer 42 is inserted in the recess portion 44 and interposed between the head portion 13 and the cylinder portion 16. An lower end of the elastomer 43 is inserted in the recess portion 45 and interposed between the high-voltage tower portion 17 and the cylinder portion 16.

According to the third embodiment of the present invention, the elastomers 42 and 43 attached to the top and bottom ends of the peripheral core 22 as shock absorbers are also utilized as seals for sealing the joint portions 32 and 33, respectively. Therefore, the joint portions 32 and 33 do not require another elastic seal for sealing, leading to reduction in production cost. Further, sealing performance of the joint portions 32 and 33 is improved because the gaps at the joint portions 32 and 33 are sealed by not only the elastomers 42 and 43 but also adhesives. The joint portions 32 and 33 may have the adhesive collecting recess as described in the second embodiment of the present invention.

(Fourth Embodiment)

A fourth embodiment of the present invention will be described with reference to FIGS. 8 and 9. In the fourth embodiment, the ignition coil 10 has the same structure as that in the third embodiment, except a shape of an elastomer 50.

In the fourth embodiment, the elastomer 50 has a plurality of annular sealing protrusions 51 on the whole outer peripheral surface of a fitting portion of the elastomer 50, which fits with the cylinder portion 16 of the coil case 11, forming bellows on the fitting portion. The sealing protrusions 51 are fitted to the inner peripheral surface of the cylinder portion 16 for sealing.

According to the third embodiment, as shown in FIG. 7, it is difficult for the elastomer 43 to improve both assembly efficiency (i.e., ease of assembly) and sealing performance at the same time because the elastomer 43 fits to the cylinder portion 16 with the whole outer peripheral surface contacting the cylinder portion 16. When adhesive strength between the elastomer 43 and the cylinder portion 16 is increased to improve sealing performance, fitting friction therebetween is excessively increased. This may cause difficulty in fitting the elastomer 43 with the cylinder portion 16. Further, the elastomer 43 may be peeled or torn due to the increased fitting friction, leading to inferior sealing. On the other hand, when the adhesive strength between the elastomer 43 and the cylinder portion 16 is decreased to reduce the fitting friction therebetween so that assembly efficiency is improved, the sealing performance of the elastomer 43 may be reduced.

According to the fourth embodiment of the present invention, the elastomer 50 does not contact the cylinder portion 16 by the whole outer peripheral surface of the fitting portion of the elastomer 50, but contact the cylinder portion 16 by the plurality of sealing protrusions 51 formed on the outer peripheral surface of the fitting portion. That is, in the fourth embodiment, an adhesion area between the elastomer 50 and the cylinder portion 16 is relatively small compared to that in the third embodiment. Therefore, the fitting friction during assembly can be reduced even when the adhesive strength is increased to improve sealing performance. Further, the elastomer 50 is prevented from being peeled or torn during assembly, leading to reliable sealing performance, because fitting friction is reduced.

(Fifth Embodiment)

A fifth embodiment of the present invention will be described with reference to FIG. 10A. In the fifth embodiment, the ignition coil 10 has the same structure as that in the third embodiment, except a shape of an elastomer 52.

Figure 10A:
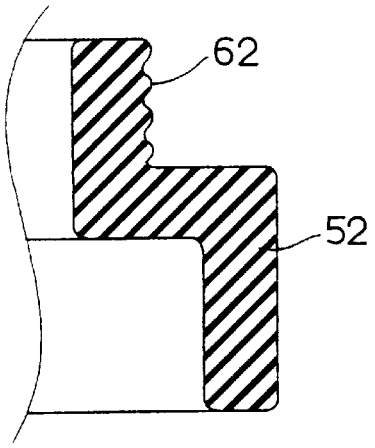
FIG. 10A is an enlarged partial cross-sectional view showing an elastomer according to a fifth embodiment of the present invention.

In the fifth embodiment, as shown in FIG. 10A, the elastomer 52 has a plurality of annular sealing protrusions 62 formed on the whole outer peripheral surface of a fitting portion of the elastomer 52 for fitting with the peripheral core 22, forming bellows on the fitting portion. The sealing protrusions 62 are fitted to the inner peripheral surface of the peripheral core 22 for sealing.

(Sixth Embodiment)

A sixth embodiment of the present invention will be described with reference to FIG. 10B. In the sixth embodiment, the ignition coil 10 has the same structure as that in the third embodiment, except a shape of an elastomer 53.

Figure 10B:
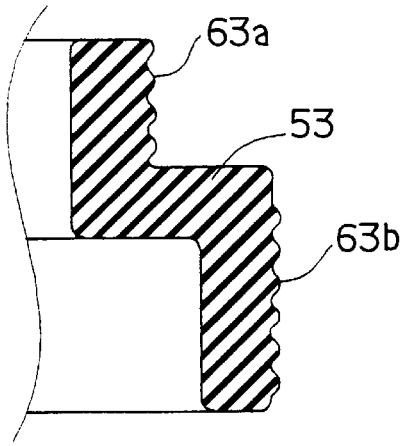
FIG. 10B is an enlarged partial cross-sectional view showing an elastomer according to a sixth embodiment of the present invention.

In the sixth embodiment, as shown in FIG. 10B, the elastomer 53 has a plurality of sealing protrusions 63*a* and 63*b* formed on the whole outer peripheral surface of a fitting portion of the elastomer 53 for fitting with the peripheral core 22, and a fitting portion of the elastomer 53 for fitting with the cylinder portion 16, respectively, forming bellows on the both fitting portions. The sealing protrusions 63*a* and 63*b* are respectively fitted to the inner peripheral surfaces of the peripheral core 22 and the cylinder portion 16 for sealing.

(Seventh Embodiment)

A seventh embodiment of the present invention will be described with reference to FIG. 10C. In the seventh embodiment, the ignition coil 10 has the same structure as that in the third embodiment, except a shape of an elastomer 54.

Figure 10C:
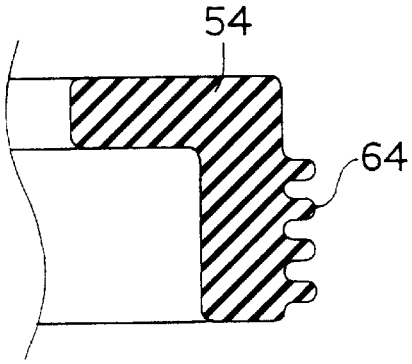
FIG. 10C is an enlarged partial cross-sectional view showing an elastomer according to a seventh embodiment of the present invention.

In the seventh embodiment, as shown in FIG. 10C, the elastomer 54 has a plurality of sealing protrusions 64 formed on the whole outer peripheral surface of a fitting portion of the elastomer 54 for fitting with the cylinder portion 16, forming fins on the fitting portion. The elastomer 54 does not have a fitting portion for fitting with the peripheral core 22.

(Eighth Embodiment)

A eighth embodiment of the present invention will be described with reference to FIG. 10D. In the eighth embodiment, the ignition coil 10 has the same structure as that in the third embodiment, except a shape of an elastomer 55.

Figure 10D:
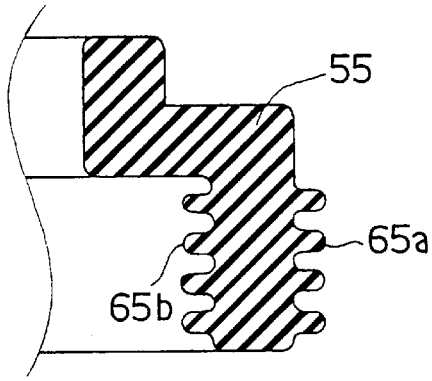
FIG. 10D is an enlarged partial cross-sectional view showing an elastomer according to an eighth embodiment of the present invention.

In the eighth embodiment, as shown in FIG. 10D, the elastomer 55 has a plurality of annular sealing protrusions 65*a* and 65*b* on outer and inner peripheral surfaces of a fitting portion of the elastomer 55 respectively, for being inserted between the cylinder portion 16 and the high-voltage tower portion 17. The sealing protrusions 65*a* and 65*b* are fitted to the inner peripheral surface of the cylinder portion 16 and the outer peripheral surface of the high-voltage tower portion 17, respectively.

(Ninth Embodiment)

A ninth embodiment of the present invention will be described with reference to FIG. 10E. In the ninth embodiment, the ignition coil 10 has the same structure as that in the third embodiment, except a shape of an elastomer 56.

Figure 8:
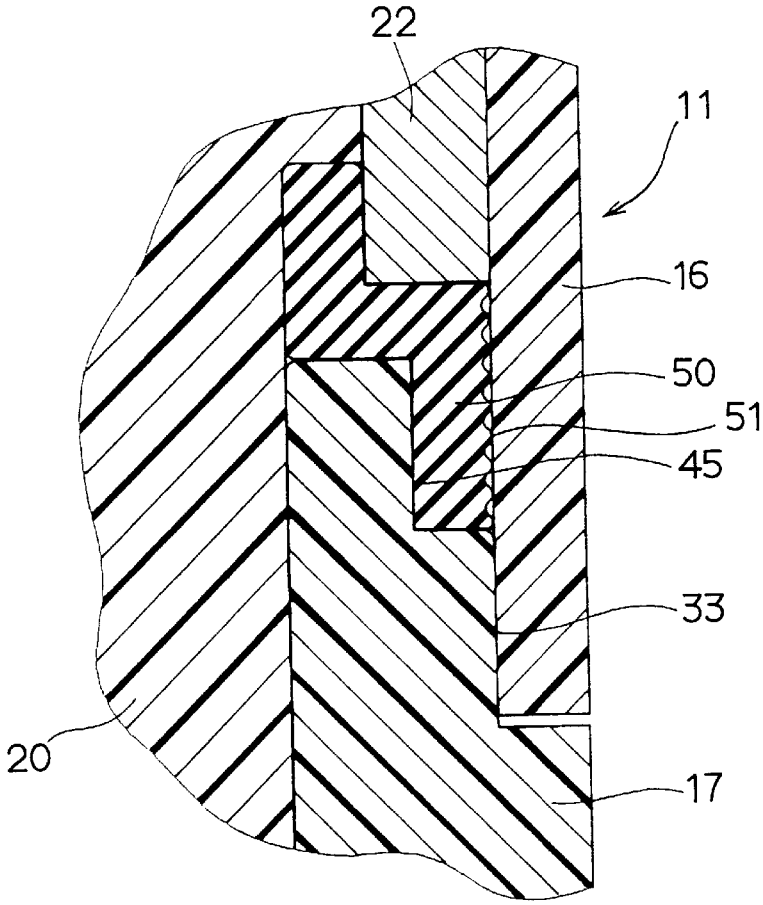
FIG. 8 is an enlarged partial cross-sectional view of portion B in FIG. 4 showing a connection structure between a cylinder portion and a high-voltage tower portion according to a fourth embodiment of the present invention.
Figure 9:
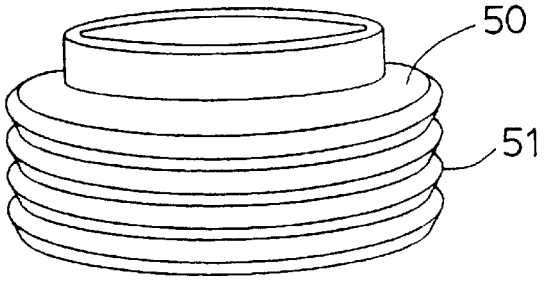
FIG. 9 is a perspective view showing an elastomer according to the fourth embodiment of the present invention.
Figure 10E:
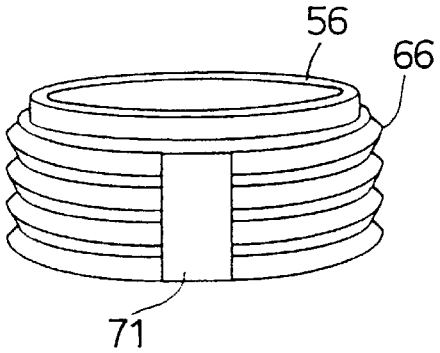
FIG. 10E is a perspective view showing an elastomer according to a ninth embodiment of the present invention.

In the ninth embodiment, as shown in FIG. 10E, the elastomer 56 has a plurality of sealing protrusions 66 on the outer peripheral surface, forming bellows, and has substantially the same shape as the elastomer 50 shown in FIGS. 8 and 9, except having a flat panel portion 71 formed on the sealing protrusions 66. The flat panel portion 71 is formed to connect each of the adjacent sealing protrusions 66 and extends in a vertical direction in FIG. 10E, providing partially a flat surface on the outer peripheral surface of the elastomer 56. The flat panel portion 71 is fitted to the inner peripheral surface of the cylinder portion 16, same as the sealing protrusions 66.

(Tenth Embodiment)

A tenth embodiment of the present invention will be described with reference to FIG. 10F. In the tenth embodiment, the ignition coil 10 has the same structure as that in the third embodiment, except a shape of an elastomer 57.

Figure 10F:
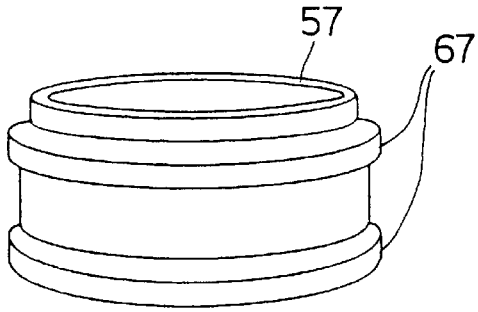
FIG. 10F is a perspective view showing an elastomer according to a tenth embodiment of the present invention.

In the tenth embodiment, as shown in FIG. 10F, the elastomer 57 has two annular sealing protrusions 67; one is formed on the upper end of a fitting portion of the elastomer 57 for fitting with the cylinder portion 16, and the other is formed on the lower end of the fitting portion. The two sealing protrusions 67 are fitted to the cylinder portion 16 for sealing.

In the above-described embodiments, elastomers are employed as the elastic cushioning material to be disposed between the peripheral core and the coil case of the ignition coil 10; however other elastic material may be employed as the elastic cushioning material. Further, the number of the sealing protrusions formed on the elastic cushioning material may be one or more.

Preferably, the elastomer may have its corners chamfered, jagged or spherical to improve assembly efficiency. Similarly, the elastomer may have tapered side to improve assembly efficiency.

In the above-described embodiments, the head portion 13, the cylinder portion 16 and the high-voltage tower portion 17 are separately formed and then assembled to form the coil case 11; however, either the head portion 13 or the high-voltage tower portion 17 may be integrally formed with the cylinder portion 16 if there is no forming flow length problem of the insulating resin of the coil case 11 which causes a molding defect. For example, when the coil case 11 has a longitudinal length more than 130 mm, a thickness less than 1.0 mm or an undercut portion, at least one of the head portion 13, the cylinder portion 16 and the high-voltage tower portion 17 is formed separately from the remaining portions. This prevents inferior molding even when the coil case 11 is elongated, formed thinner or formed with an undercut portion. Further, each part of the coil case 11 can be molded with a simple structured molding die, resulting in a reduction in molding cost.

Furthermore, the present invention applies to the ignition coil 10 even when the coil case 11 has a longitudinal length of less than 130 mm, or has a thickness of more than 1.0 mm, or has no undercut portion.

Further, the structures of the joint portion 32 between the head portion 13 and the cylinder portion 16 and the joint portion 33 between the cylinder portion 16 and the high-voltage tower portion 17 may be modified if necessary.

Although the present invention has been fully described in connection with preferred embodiments thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. An ignition coil for a spark plug, comprising:

a coil case made of resin and which includes:

a head portion including a connector housing;

a cylinder portion having a primary coil and a secondary coil therewithin; and a high-voltage tower portion for holding said secondary coil in electrical contact with said spark plug, wherein;

at least one of said head portion, said cylinder portion, and said high-voltage tower portion is formed independently from a remainder of said portions to define a respective formed portion, and said coil case is defined by an assembly of said independently formed portion and said remainder of said portions, with an annular seal having an annular sealing protrusion disposed therebetween.

2. An ignition coil according to claim 1, wherein;

said annular seal includes a plurality of said annular sealing protrusions.

3. An ignition coil according to claim 2, wherein;

said annular sealing protrusions form a bellows shape.

4. An ignition coil according to claim 1, further comprising:

a peripheral core that is installed in said cylinder portion, wherein;

said annular seal is made of an elastic cushioning material and contacts said peripheral core.

5. An ignition coil according to claim 4, wherein;

said annular seal is located between said peripheral core and said coil case.

6. An ignition coil for a spark plug, comprising:

a coil case made of resin and including:

a head portion including a connector housing;

a cylinder portion having a primary coil and a secondary coil disposed therewithin; and a high-voltage tower portion for attaching to the spark plug, wherein;

at least one of said head portion, said cylinder portion, and said high-voltage tower portion is independently formed from a remainder of said portions to define a respective independently formed portion, said coil case is defined by an assembly of each said independently formed portion and said remainder of said portions, a joint portion being defined between each said independently formed portion and each portion of said remainder of said portions, and further comprising:

a seal for respectively contacting a periphery of each said joint portion, to seal said respective joint portion.

7. An ignition coil according to claim 6, further comprising:

a peripheral core that is installed in said cylinder portion, wherein;

said seal is made of an elastic cushioning material and contacts said peripheral core.

8. An ignition coil according to claim 7, wherein;

said seal includes an annular sealing protrusion that is formed at least one of (1) between said coil case and said seal, and (2) between said peripheral core and said seal.

9. An ignition coil according to claim 8, wherein;

said seal includes a plurality of said annular sealing protrusions.

10. An ignition coil according to claim 9, wherein;

said annular sealing protrusions form a bellows shape.

11. An ignition coil according to claim 6, wherein;

said seal is an adhesive; and said joint portion further includes an adhesive collecting recess that is formed on said periphery of said joint portion.

12. An ignition coil for a spark plug comprising:

a coil case made of resin and which includes:

a head portion including a connector housing;

a cylinder portion having a primary coil, a secondary coil and a core disposed therewithin;

a high-voltage tower portion for holding said secondary coil electrically connected to the spark plug; and a plurality of annular seals that seal between said head portion and said cylinder portion and between said cylinder portion and said high-voltage tower portion, said seals having a plurality of annular sealing protrusions between said cylinder portion and said seals, said seals being made of an elastic cushioning material, wherein;

each of said head portion, said cylinder portion, and said high-voltage tower portion is independently molded to respectively define discrete molded portions, said coil case being defined by an assembly of said molded portions with seals therebetween.

13. An ignition coil for a spark plug comprising:

a coil case made of resin and which includes:

a head portion including a connector housing;

a cylinder portion having a primary coil and a secondary coil disposed therein; and a high-voltage tower portion for holding said secondary coil electrically connected to said spark plug, wherein;

at least one of said head portion, said cylinder portion, and said high-voltage tower portion is independently formed to define a respective separately formed portion, said coil case is defined by an assembly of said head portion, said cylinder portion, and said high-voltage tower portion after the at least one separately formed portion has been formed, and each said separately formed portion satisfies at least one of the following conditions: (1) an axial length of said separately formed portion is shorter than a length of the coil case, (2) a thickness of said separately formed portion is 1.0 mm or less, and (3) said separately formed portion has an undercut portion, wherein a joint portion is defined between each said separately formed portion and each remaining portion, each said separately formed portion and each said remaining portion being bonded with adhesive at each said joint portion, wherein said each separately formed portion and each said remaining portion have respective recessed portions for receiving an annular seal therebetween on assembly.

* * * * *